US006507008B2

(12) United States Patent
Nakayama et al.

(10) Patent No.: US 6,507,008 B2
(45) Date of Patent: Jan. 14, 2003

(54) IMAGE FORMING APPARATUS AND FIXING DEVICE FOR FIXING A TONER IMAGE TO A FIXING DEVICE

(75) Inventors: Hiroshi Nakayama, Kawasaki (JP); Hisaaki Kawano, Chigasaki (JP); Kenji Takano, Tokyo (JP); Taizo Kimoto, Tokyo (JP); Noriyuki Umezawa, Yokohama (JP); Osamu Takagi, Tokyo (JP); Satoshi Kinouchi, Tokyo (JP); Kazuhiko Kikuchi, Yokohama (JP); Masahiko Ogura, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,727

(22) Filed: Aug. 28, 2001

(65) Prior Publication Data

US 2002/0027134 A1 Mar. 7, 2002

Related U.S. Application Data

(63) Continuation of application No. PCT/JP99/07409, filed on Dec. 28, 1999.

(51) Int. Cl.[7] ..... H05B 6/14; G03G 15/20

(52) U.S. Cl. ..... 219/619; 219/667; 399/330; 399/336

(58) Field of Search ..... 219/619, 667, 219/665; 399/328, 330, 334, 335, 336

(56) References Cited

U.S. PATENT DOCUMENTS

| | | | | |
|---|---|---|---|---|
| 5,752,150 A | | 5/1998 | Kato et al. | 399/330 |
| 5,832,354 A | * | 11/1998 | Kouno et al. | 399/330 |
| 6,037,576 A | * | 3/2000 | Okabayashi et al. | 219/619 |
| 6,278,852 B1 | * | 8/2001 | Hayashi | 219/619 |

FOREIGN PATENT DOCUMENTS

| | | |
|---|---|---|
| JP | 57-128373 | 8/1982 |
| JP | 59-33476 | 2/1984 |
| JP | 59-123868 | 7/1984 |
| JP | 1-310380 | 12/1989 |
| JP | 8-76620 | 3/1996 |
| JP | 9-258586 | 10/1997 |
| JP | 10-301442 | 11/1998 |

* cited by examiner

*Primary Examiner*—Philip H. Leung
(74) *Attorney, Agent, or Firm*—Foley & Lardner

(57) ABSTRACT

The present invention is a fixing device for use in an electrophotographic apparatus arranged in a structure in which a high-frequency current is flowed through an induction coil provided close to an endless member having a metal layer made of a conductive material and the endless member is caused to generate heat to heat a material to be fixed. This fixing device is characterized in that, when a start-up operation is started by electrically conducting the induction coil, the endless member is rotated after the metal layer reaches a temperature higher than a final setting temperature, and for a predetermined time from starting rotation of the endless member, a high-frequency current having a size corresponding to a control value of a temperature lower than the final setting temperature and higher than a target temperature is supplied to the coil.

10 Claims, 6 Drawing Sheets

IMAGE FORMING APPARATUS AND FIXING DEVICE FOR FIXING A TONER IMAGE TO A FIXING DEVICE

CROSS-REFERENCE TO RELATED APPLICATIONS

This is a Continuation Application of PCT Application No. PCT/JP99/07409, filed Dec. 28, 1999, which was not published under PCT Article 21(2) in English.

BACKGROUND OF THE INVENTION

1. Field of the Invention

The present invention relates to an image forming apparatus such as an electrostatic copying machine, a laser printer, or the like in which a toner image is fixed to a fixing material.

2. Description of the Related Art

In a fixing device incorporated in a copying machine using an electrophotographic process, a developer which is toner supplied onto a fixing material is heated and melted to fix the toner to the fixing material. A method of using radiated heat based on a halogen lamp (a filament lamp) is widely used as a method for heating toner usable for a fixing device.

With respect to the method of using a halogen lamp as a heat source, a structure is widely used, i.e., paired rollers are provided such that a predetermined pressure can be applied to the fixing material and toner, at least one of the paired rollers is used as a hollow column, and a halogen lamp arranged like a column is arranged in the inner hollow space. In this structure, the roller provided with a halogen lamp forms an acting part (nip) at a position where the roller contacts the other roller, so that pressure and heat are applied to a fixing material and toner guided to the nip. That is, the fixing material, i.e., a paper sheet is passed through a fixing point which is a press contact part between a heat roller provided with a lamp and a press roller which rotates as a slave to the heat roller, and thus, toner on the paper sheet is melted and fixed to the paper sheet.

In the fixing device using a halogen lamp, light and heat from the halogen lamp is radiated in all directions to the entire circumference of the heat roller, so that the entire roller is heated. In this case, it is known that the thermal conversion efficiency is 60 to 70%, which is low, the power consumption is large, and the warm-up time is long, in consideration of the loss at the time when light is converted into heat, the efficiency at which air in the roller is warmed to transfer heat to the holler, and the like.

Hence, in recent years, as a heat source for a heat roller, an induction heating method has been practiced, in which a heat coil is provided inside a heat roller and a high-frequency current is supplied to the coil, so that heating is carried out by induction heating.

For example, Japanese Patent Application KOKAI Publication No. 59-33476 discloses a technique in which a roller having a thin metal layer on the outer circumference of a ceramic cylinder is comprised and an induction current is passed through the thin metal layer of the roller by the conductive coil to achieve heating.

Japanese Patent Application KOKAI Publication No. 78-76620 discloses a device in which a conductive film is heated by a magnetic field generation means, and toner is fixed to a paper sheet kept in tight contact with the conductive film. A heat belt (conductive film) is sandwiched between a member forming part of the magnetic field generation means and a heat roller, to form a nip.

Japanese Patent Application KOKAI Publication No. 258586 discloses a method which uses a heat generation member in which a coil is wound around a core provided along the rotation axis of a fixing roller, and which achieves heating by producing eddy currents through the fixing roller.

However, it is known that a temperature distribution appears on the surface of a heat coil, depending on the shape of the coil, in the case of electrically conducting a coil to heat a heat roller.

Hence, at the time when the roller surface reaches a predetermined temperature after a predetermined time has elapsed from the electric conduction to the coil, it is normally necessary to rotate the heat roller and a press kept in contact with each other, to uniform the temperature distribution of the heat roller.

However, the temperature of the heat roller which has once risen drops rapidly since the heat roller and the press roller are rotated. Therefore, a high-frequency current must be continuously supplied to heat the heat roller until the temperature rises up to a temperature which enables fixing.

This means in which the image forming operation is stopped until the fixing operation is enabled, results in a problem that the electric power required for heating increases.

BRIEF SUMMARY OF THE INVENTION

The present invention has an object of providing an image forming apparatus capable of shortening the time from when the power source is turned on to when copying can be accepted, i.e., a so-called first copy time, and also capable of supplying an effective maximum electric power for a fixing device without exceeding the upper limit of power consumption.

The present invention provides a fixing device for use in an electrophotographic apparatus arranged in a structure in which a high-frequency current is flowed through an induction coil provided close to an endless member having a metal layer made of a conductive material and the endless member is caused to generate heat to heat and fix a material to be fixed, while maintaining a first temperature, wherein when electric conduction to the coil is started and a start-up operation is started, the endless member is rotated when the metal layer reaches a second temperature higher than the first temperature, and for a predetermined time from the start of rotation of the endless member, a high-frequency current having a size corresponding to a control value for a third target temperature is supplied to the coil, the third temperature being lower than the second temperature and higher than the first temperature.

The present invention also provides a fixing device for use in an electrophotographic apparatus arranged in a structure in which an alternating current is passed through an induction coil provided close to an endless member having a metal layer made of a conductive material, and the endless member is caused to generate heat to heat a material to be fixed, wherein in a warm-up period, an electric power amount supplied to the induction coil is changed in a plurality of steps, in compliance with the operation of another component.

The present invention further provides a fixing device for use in an electrophotographic apparatus arranged in a structure in which a high-frequency current is passed through an induction coil provided close to an endless member having a metal layer made of a conductive material, and the endless member is caused to generate heat to heat a material to be fixed, while maintaining a first temperature, wherein when electric conduction to the coil is started and a start-up operation is started, the endless member is rotated when the metal layer reaches a second temperature higher than the first temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

In the following, a fixing device as an embodiment according to the present invention will be explained with reference to the drawings.

Figure 1:
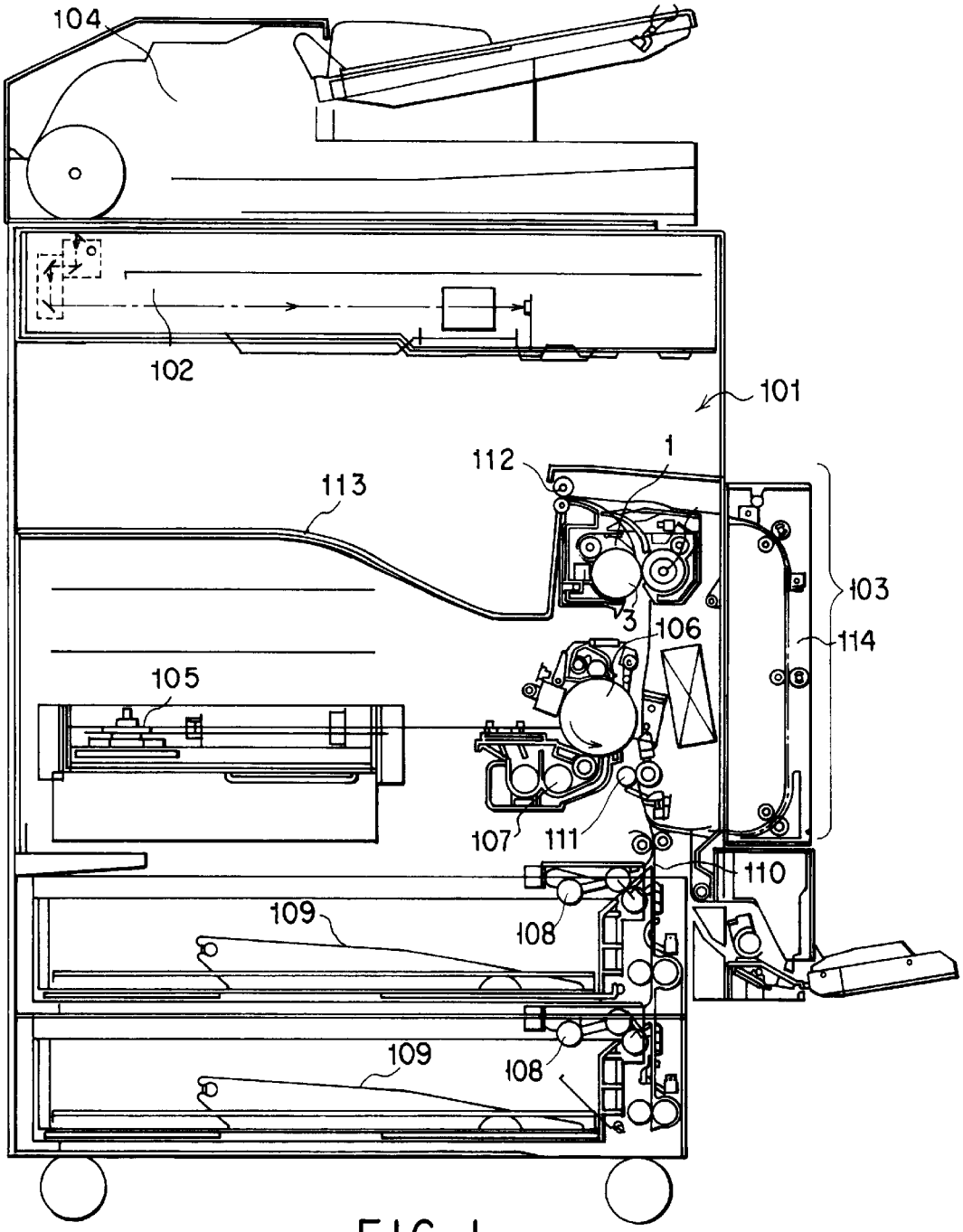
FIG. 1 is a schematic view illustrating a digital copying machine which incorporates a fixing device as an embodiment according to the present invention.

FIG. 1 is a schematic view which explains a digital copying machine 101 as an example of an image forming apparatus. As shown in FIG. 1, the digital copying machine 101 includes a scanner 102 which reads image information of a copy target as brightness and darkness of light and generates an image signal, and an image forming section 103 which forms an image corresponding to the image signal supplied from the scanner 102 or the outside. Note that the scanner 102 is integrally provided with an automatic document feeder (ADF) 104 which operates in association with the operation of reading an image by the scanner 102 and replaces copy targets sequentially, when the copy targets are sheet-like materials.

The image forming section 103 includes an exposure device 105 for irradiating a laser beam corresponding to image information supplied from the scanner 102 or an external device, a photosensitive drum 106 for holding an image corresponding to the laser beam from the exposure device 105, a developing device 107 for supplying a developer to an image formed on the photosensitive drum 106 to develop the image, and a fixing device 1 for heating and melting a developer image transferred from the photosensitive drum 106, on which the developer image has been developed by the developing device 107, to a transfer material supplied from a sheet conveyer section explained later.

When image information is supplied from the scanner 102 or an external device, a laser beam subjected to intensity-modulation based on the image information is irradiated onto the photosensitive drum 106 which has previously been charged to a predetermined electric potential.

In this manner, an electrostatic latent image corresponding to an image to be copied is formed on the photosensitive drum 106.

The electrostatic latent image formed on the photosensitive drum 106 is selectively supplied with toner T and developed by the developing device 107, and is then transferred to a paper sheet P as a transfer material supplied from a cassette explained later, by a transfer device.

The toner T transferred to the paper sheet P is conveyed to the fixing device 1 where the toner T is melted and fixed.

Each of the paper sheets P is picked up one after another from a sheet cassette 109 provided below the photosensitive drum 106 by a pickup roller 108, pass through a conveyor path 110 oriented to the photosensitive drum 106, and is conveyed to an aligning roller 111 for aligning the paper sheet with the toner image (developer image) formed on the photosensitive drum 106. Each paper sheet is supplied, at a predetermined timing, to a transfer position where the photosensitive drum 106 and the transfer device face each other.

Meanwhile, the paper sheet P to which an image formed of toner T has been fixed by the fixing device 1 is fed out into an ejection space (sheet ejection tray) defined between the scanner 102 and the cassette 109. A double-side sheet feeder 114 which reverses the front and back surfaces of the paper sheet P with the image fixed to one surface is provided between the fixing device 1 and the cassette 109, if necessary.

Next, the fixing device 1 will be explained in detail.

Figure 2:
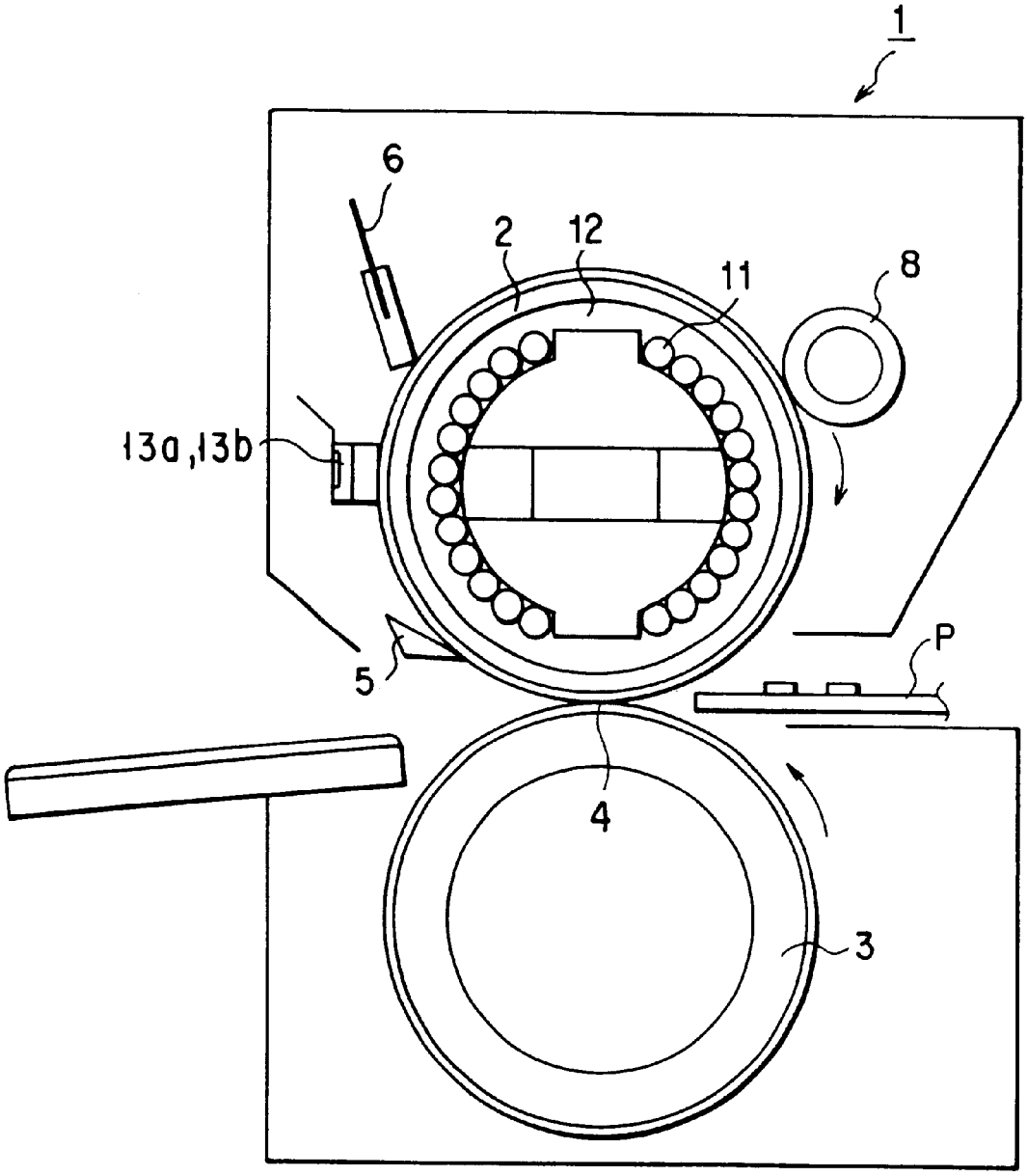
FIG. 2 is a schematic view showing the entire structure of the fixing device of the copying machine shown in FIG. 1.
Figure 3:
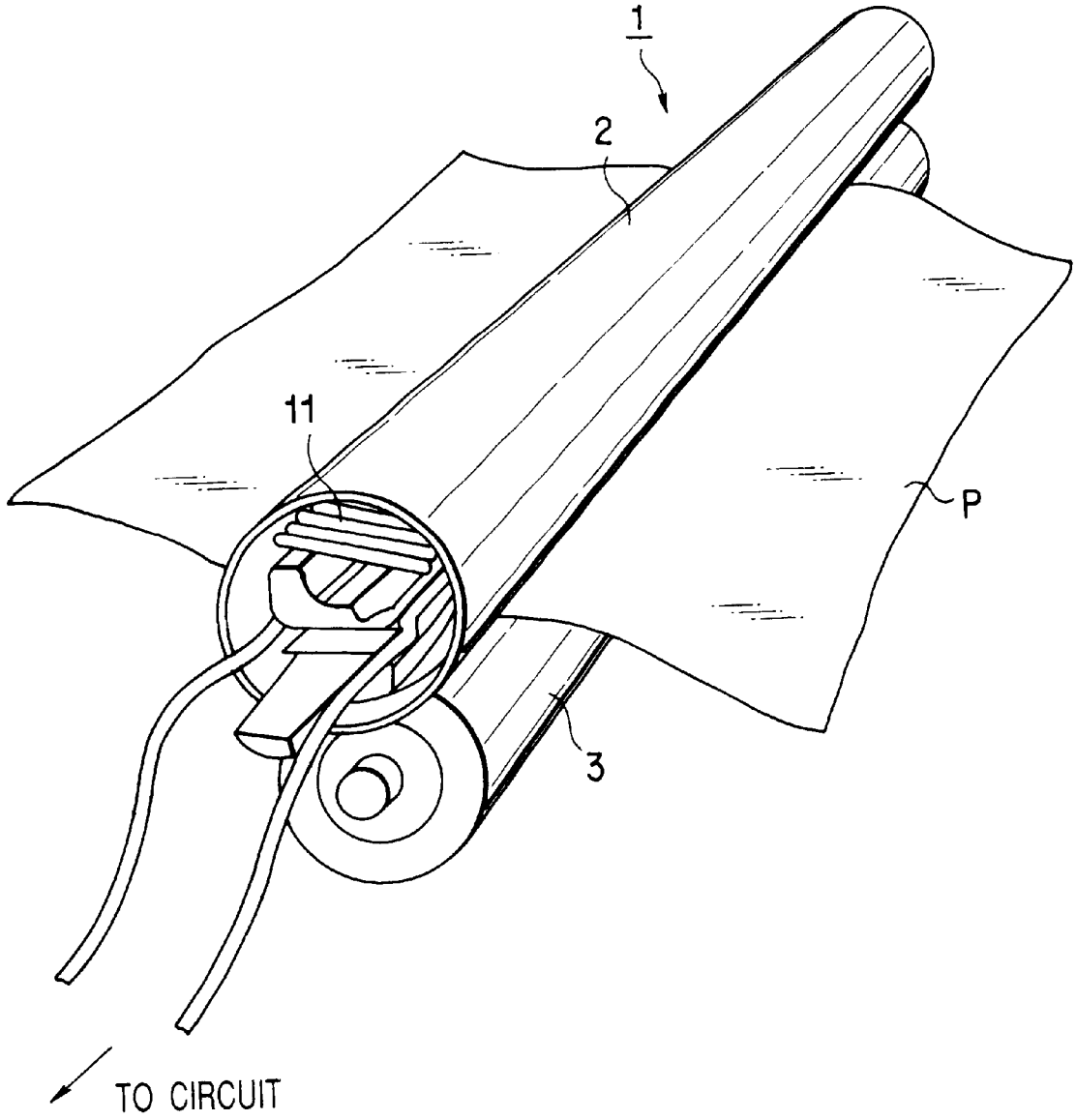
FIG. 3 is a perspective view schematically showing the structure of a heat roller and a magnetic field generation means in the fixing device shown in FIG. 2.

FIG. 2 is a schematic cross-sectional view which explains an embodiment of the fixing device incorporated in the digital copying machine shown in FIG. 1. FIG. 3 is a schematic perspective view showing the shape of a coil incorporated in the fixing device shown in FIG. 2.

As shown in FIGS. 2 and 3, the fixing device 1 is constructed by a heat (fixing) roller 2 and a press roller 3. Each of the rollers has an outer diameter of 40 mm, for example.

The heat roller 2 is driven in the arrow direction by a drive motor not shown. Note that the press roller 3 rotates in the arrow direction in association with the heat roller. A paper sheet P as a fixing material supporting a toner image T is passed through between both rollers.

The heat roller 2 is, for example, an endless member having a metal layer, e.g. an iron-made cylinder having a thickness of 1 mm, i.e., conductive material. A mould-releasing layer of Teflon or the like is formed on the surface of the member. In addition, stainless steel, aluminum, an alloy of stainless steel or aluminum, or the like can be used for the heat roller 2.

The press roller 3 is constructed by coating an elastic material such as silicon rubber, fluoro rubber, or the like on the circumference of a core metal 3*a*. The heat roller 3 is pressed against a heat roller 2 at a predetermined pressure by a press mechanism not shown, thereby to create a nip (where the outer circumferential surface of the press roller 3 is elastically deformed by a press contact) having a predetermined width at a position where both rollers contact each other.

In this manner, as a paper sheet 4 passes through the nip 4 and toner on the paper sheet is melted and fixed to the paper sheet P.

In the downstream side of the nip 4 on the circumference of the heat roller 2 in the rotating direction, a peeling nail 5 for peeling the paper sheet P off from the heat roller 3, an off-set cleaning member 6 for removing toner or paper fragments, etc transferred to the outer circumferential surface of the heat roller 2, a mould-releasing agent application device 8 for applying a mould-releasing agent to prevent toner from sticking to the outer circumferential surface of the heat roller 2, and thermistors 13*a*, 13*b* for detecting the temperature of the outer circumferential surface of the heat roller 2.

A magnetic excitation coil 11 as a magnetic field generation means made of a litz wire is provided inside the heat roller 2, and the litz wire is constructed by a plurality of bundled copper wire members insulated from each other and each having a diameter of, for example, 0.5 mm. By constructing the magnetic excitation coil by a litz wire, the wire diameter can be reduced to be smaller than the penetration depth, so that a high-frequency current can effectively flow. The magnetic excitation coil 11 used in the embodiment shown in FIG. 2 is constructed by 19 heat-resistant wire members each having a diameter of 0.5 mm and coated with polyamide-imide.

The magnetic excitation coil 11 is also an air-core coil which does not use any core member (such as a ferrite core, an iron core, or the like). Since the magnetic excitation coil 11 is thus formed as an air-core coil, a core member having a complicated shape is not required, so that costs are reduced. Also, the price of the magnetic excitation circuit can be reduced.

The magnetic excitation coil 11 is supported by a coil support member 12 formed of heat-resistant resin (e.g., industrial plastics having a high heat resistance).

The coil support member 12 is positioned by a structure (metal plate), not shown, but holding the heat roller.

The magnetic excitation coil 11 causes the heat roller 2 to generate magnetic flux and eddy currents, so that changes of the magnetic field are prevented by magnetic flux generated by a high-frequency current from a magnetic excitation circuit (inverter circuit) explained in later paragraphs with reference to FIG. 4. Joule heat is generated by the eddy currents and the resistance specific to the heat roller 2, so the heat roller 2 is heated. In this embodiment, a high-frequency current of 25 kHz and 900 W flows through the magnetic excitation coil 11.

Figure 4:
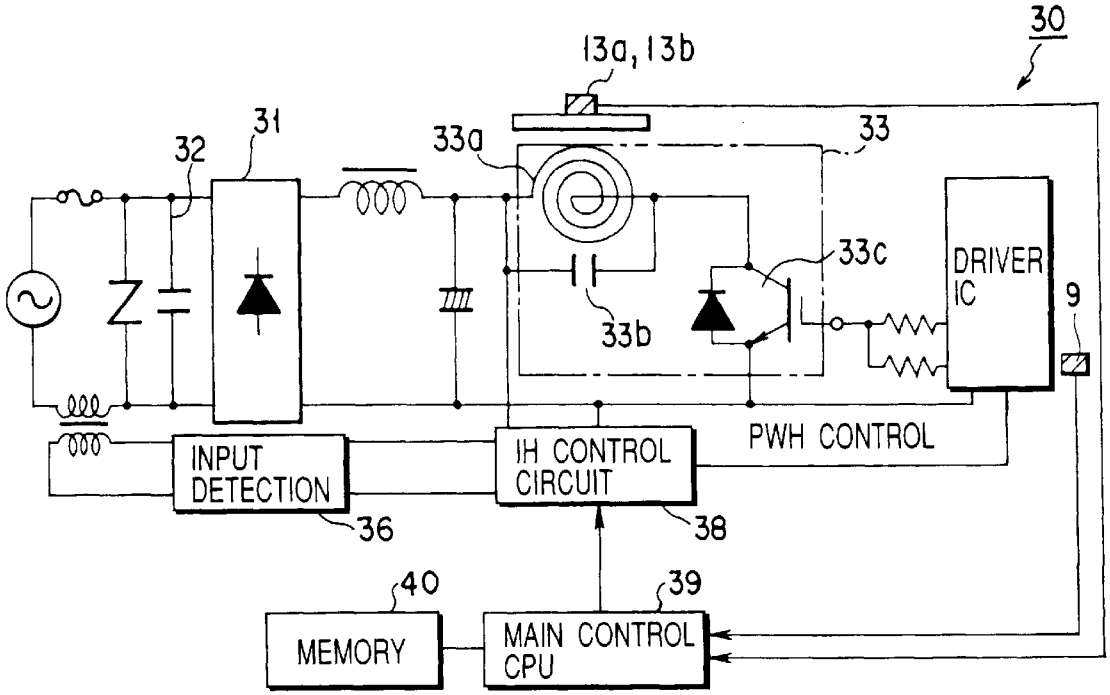
FIG. 4 is a schematic view which illustrates a drive circuit diagram (a semi-E-class inverter circuit) for driving an induction heating coil of the fixing device shown in FIG. 2.
Figure 5:
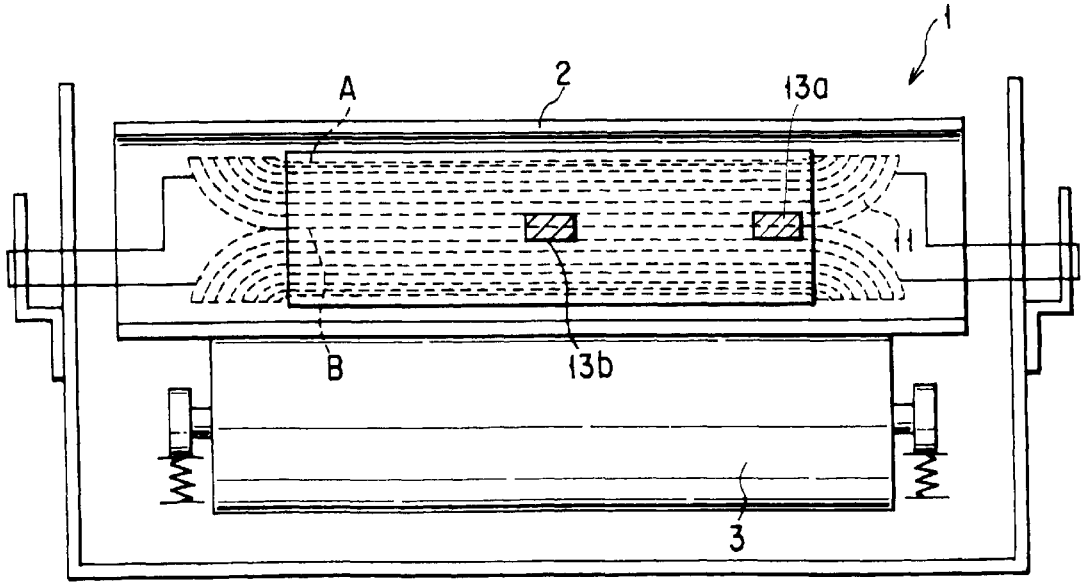
FIG. 5 is a schematic view which illustrates the structure of the fixing device shown in FIG. 2, in its lengthwise direction.

FIG. 4 is a block diagram showing the control system, i.e., a drive circuit of the fixing device shown in FIGS. 2 and 3.

In the drive circuit 30, the high-frequency current is obtained by rectifying an alternate current from a commercial power source by means of a rectifier circuit 31 and a smoothing capacitor 32, and is supplied to the magnetic excitation coil 11 through a coil 33*a*, a resonant capacitor 33*b*, and a switching circuit 33*c*.

The high-frequency current is detected by an input detection means 36 and is controlled to attain a specified output value. Note that the specified output value can be controlled by changing the ON time of the switching element 33*c* at an arbitrary timing, for example, under PWM (Pulse Width Modulation) control. At this time, the drive frequency is changed optimally. Changes of an input voltage are also detected by the input detection means 36.

Information from a temperature detection means (two thermistors 13*a* and 13*b* explained later and provided at two positions on the surface of the heat roller 2) for detecting the temperature of the heat roller 2 is inputted to the main control CPU 39 and is further inputted to an IH (induction heating) circuit 38 in accordance with an ON/OFF signal from the CPU 39. An output from thermistors 13*a*, 13*b* are also inputted to the IH circuit 38 and serves to control an abnormal temperature of a driver IC. In addition, a D/A converter 40 for changing the size of the high-frequency current outputted from the IH circuit 38 is connected between the main control CPU 39 and the IH circuit 38, and a timer circuit 41 is connected with the main control circuit 39. The main control CPU 39 controls the scanner 102, the ADF 104, the exposure device 105, the developing device 107, a large number of components forming part of a motor (not shown) for rotating the photosensitive drum 106 and the image forming section 103, the pickup roller 108, the aligning roller 111, the ejection roller 112, and the like. The operation status of these components, conveying status (jamming of paper) of paper sheets P conveyed through the conveyor path 110, and the like are reported sequentially through an interface not shown, to control them.

In FIG. 2, the surface temperature of the heat roller 2 is controlled to 180° C. by temperature detection based on the thermistors 13*a*, 13*b* and by feedback control based on a detection result.

A condition necessary for fixing toner to a paper sheet P is to uniform the temperature of the entire area in directions toward the circumference of the heat roller 2. If the heat roller 2 stops rotating, generation of magnetic flux acts with different intensities in directions toward the circumference due to the characteristic of the magnetic excitation coil 11 as an air-core coil shown in FIG. 2. The temperature distribution is therefore not uniform. Consequently, unevenness of the temperature between the directions to the circumference of the roller 2 must be eliminated immediately before a paper sheet P passes through the nip 4.

Therefore, the heat roller 2 and the press roller 3 are rotated after a predetermined time to uniform the temperature distribution of the entire roller, although rotation of the heat roller 2 is stopped for a constant time period in order to increase efficiently the temperature of the heat roller 2 immediately after the magnetic excitation coil 11 is electrically conducted.

By rotating the heat roller 2 and the press roller 3, a constant amount of heat is applied to the entire surface of both of the rollers. In addition, the surface temperature decreases to be temporarily lower than the surface temperature 180° C. as an aimed control temperature as will be explained later with reference to FIG. 7, because both of the rollers 2 and 3 rotate.

This means an increase of the warm-up time required for enable fixing. Hence, the high-frequency power outputted from the IH circuit 38 shown in FIG. 4 should preferably be changed by temporarily changing the output of the D/A converter 40, to increase the heating time as will be explained in later paragraphs with reference to FIGS. 6 and 7.

When the surface temperature of the heat roller 2 reaches 180° C., copy operation is enabled, and a toner image is formed on a paper sheet P at predetermined timing.

As the paper sheet P passes through a roll-contact part, i.e., the nip 4 between the heat roller 2 and the press roller 3, the toner on the paper sheet P is fixed to the same paper sheet P.

The thermistors 13*a* and 13*b* are useful for removing influences from differences in the temperature distribution of the outer surface of the heat roller 2 which are caused due to the characteristic of the magnetic excitation coil 11 in a case where the heat roller 2 and the press roller 3 are stopped. A thermistor 9 serves to detect the temperature of the driver IC itself and forcedly shuts off electric conduction to the coil when abnormal heat generation occurs in the driver IC.

Figure 6:
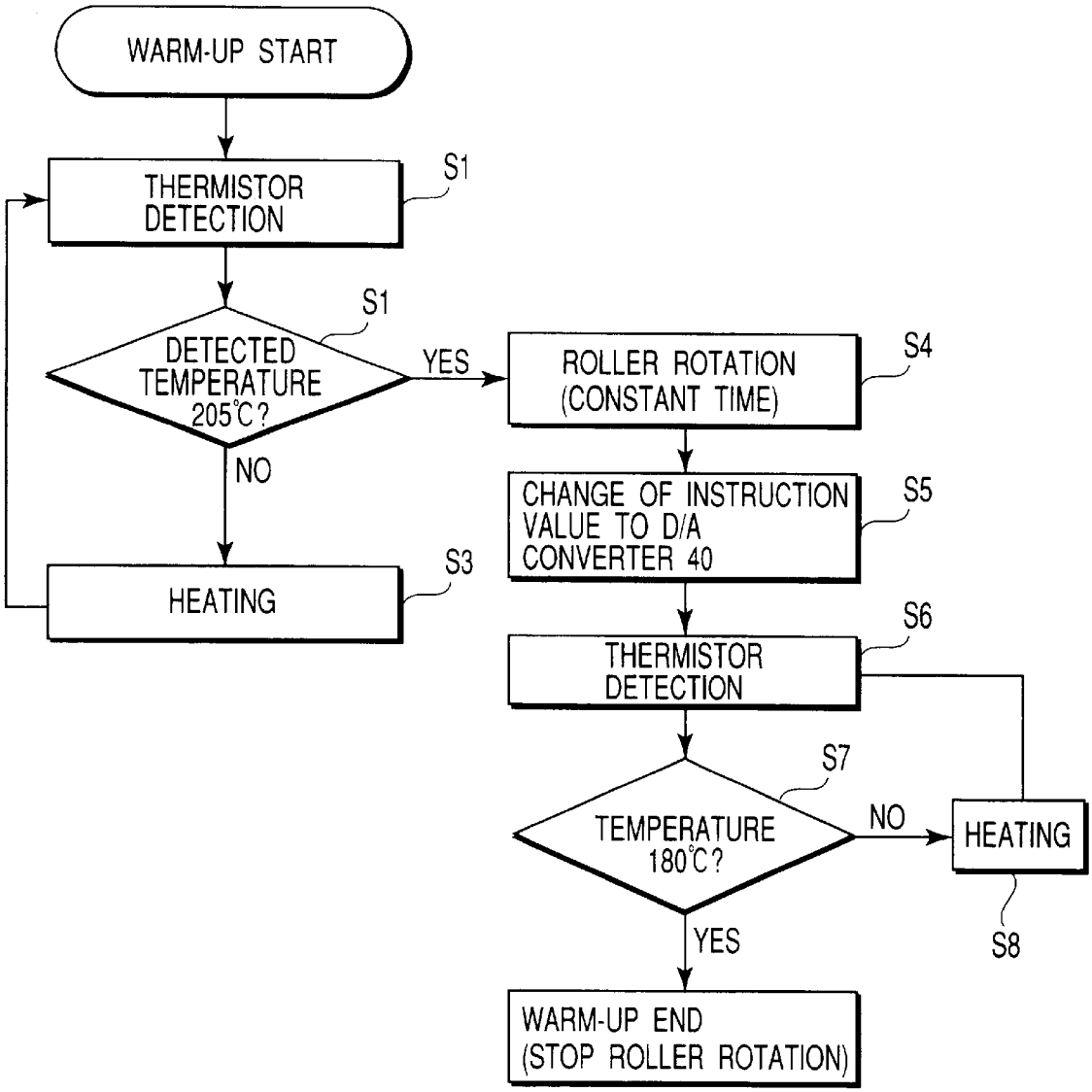
FIG. 6 is flowchart showing the operation of the fixing device shown in FIG. 2.
Figure 7:
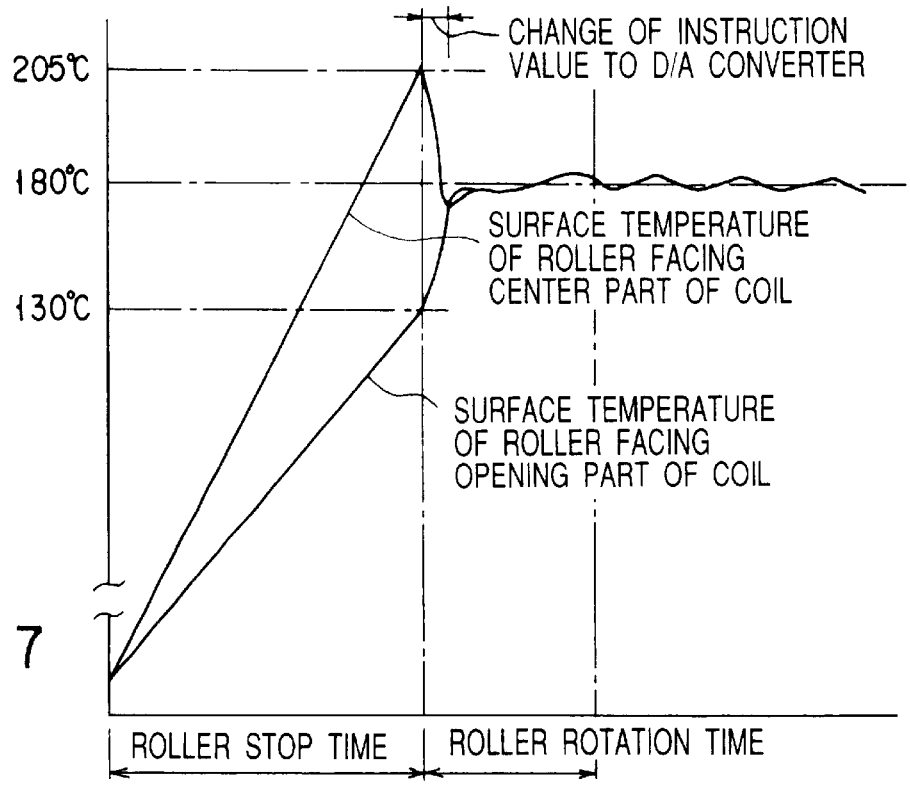
FIG. 7 is a graph for explaining a temperature increase of the fixing roller in a warm-up period of the fixing device shown in FIG. 6.

More specifically, as shown in FIGS. 6 and 7, control at the time of start-up is carried out in the following manner, as shown in the flowchart shown in FIG. 6. The extent to which the magnetic excitation coil 11 is heated by a high-frequency current from a drive circuit is sequentially detected by the thermistors (temperature sensor) 13*a*, 13*b* (S1). Heating is continued (S3) until the detection temperature comes to be, for example, 205° C. which is higher by a predetermined degree than 180° C. as a roller temperature during normal use (S2). At the time when the roller temperature reaches 205° C. (YES in S2), the heat roller 2 is rotated. That is, the heat roller 2 is not rotated but heated until a predetermined time (when the temperature of the roller 2 reaches 205° C.) is elapsed after a drive current is supplied to the magnetic excitation coil 11 (S3).

At the time when the temperature of the surface of the heat roller 2 reaches 205° C., the roller 2 is rotated (S4). The temperature of the outer surface of the heat roller 2 rapidly decreases to about 160° C. since the press roller 3 deprives heat of the heat roller 2. Therefore, an instruction value to the IH circuit 38 is changed temporarily (for about two seconds) by the D/A converter 40, so a high-frequency current which changes the surface temperature of the heat roller 2 to 200° C. At this time, the instruction value must be set so that the total power might not exceed an allowable value (S5).

In the following, the thermistors 13*a*, 13*b* continues to monitor the temperature of the outer surface of the heat roller 2 (S6). Until the temperature of the outer surface of the heat roller 2 reaches 180° C. (S7), the magnetic excitation coil 11 is supplied with a drive current to heat the heat roller 2 (S8).

Thus, the magnetic excitation coil 11 is supplied with a high-frequency current having a predetermined size which sets the roller surface temperature to 200° C. for about two seconds, to heat the roller 2 (S8) until the thermistors 13*a*, 13*b* detects that the temperature of the outer surface of the heat roller 2 reaches 180° C. (YES in S7).

FIG. 7 is a graph which explains the relationship between the temperature of each part of the heat roller 2 and the heating time when heating is carried out by heating control as shown in FIG. 6. This graph shows a state as follows. The thermistors 13*a*, 13*b* are provided so as to face the center part (where the temperature rises most) of the magnetic excitation coil 11. Heating is carried out until 205° C. higher than 180° C. as a temperature in normal operation is obtained. When the heat roller 2 is rotated to uniform the temperatures of the two rollers, the size of the high-frequency current supplied to the magnetic excitation coil 11 is temporarily changed so that a temperature higher than an aimed temperature in normal operation is obtained for a predetermined time after rotation of the heat roller 2 is started. In this manner, the surface temperature which is substantially 180° C. is obtained immediately after the rotation of the roller 2 is started.

Thus, when the outer surface of the heat roller 2 is heated, the heat roller 2 is heated without rotation until the thermistors 13*a*, 13*b* kept in contact with the outer surface of the roller 2 detects a temperature which is about 20° C. higher than the roller surface control temperature (the temperature is controlled to 180 during rotation in the present embodiment). Immediately after starting rotation, heating is carried out, with a higher temperature than an aimed temperature set as an aimed value. In this manner, the heating time (warm-up time) can be reduced.

That is, as shown in FIG. 7, the heat roller 2 is heated without rotation until the thermistors 13*a*, 13*b* kept in contact with the outer surface of the heat roller 2 reaches a higher temperature by a predetermined degree than the roller surface control temperature during operation, when heating the outer surface of the heat roller 2. Thereafter (after starting rotation), the temperature of the outer surface of the heat roller 2 can be raised substantially to 180° C. in a brief time after starting rotation of the heat roller 2, by supplying a high-frequency current for a predetermined time period, based on a control value corresponding to a higher temperature than the aimed temperature. Subsequently, the outer surface of the heat roller 2 may be controlled such that the outer surface of the heat roller 2 is, for example, at 180° C.

In the heating method as described above, at the time when both the rollers 2 and 3 are rotated, the temperature of the outer surface of the heat roller 2 is uniformed so that the temperature of the heat roller 2 reaches 180° C. The time required for warm-up is thus greatly shortened.

Figure 8:
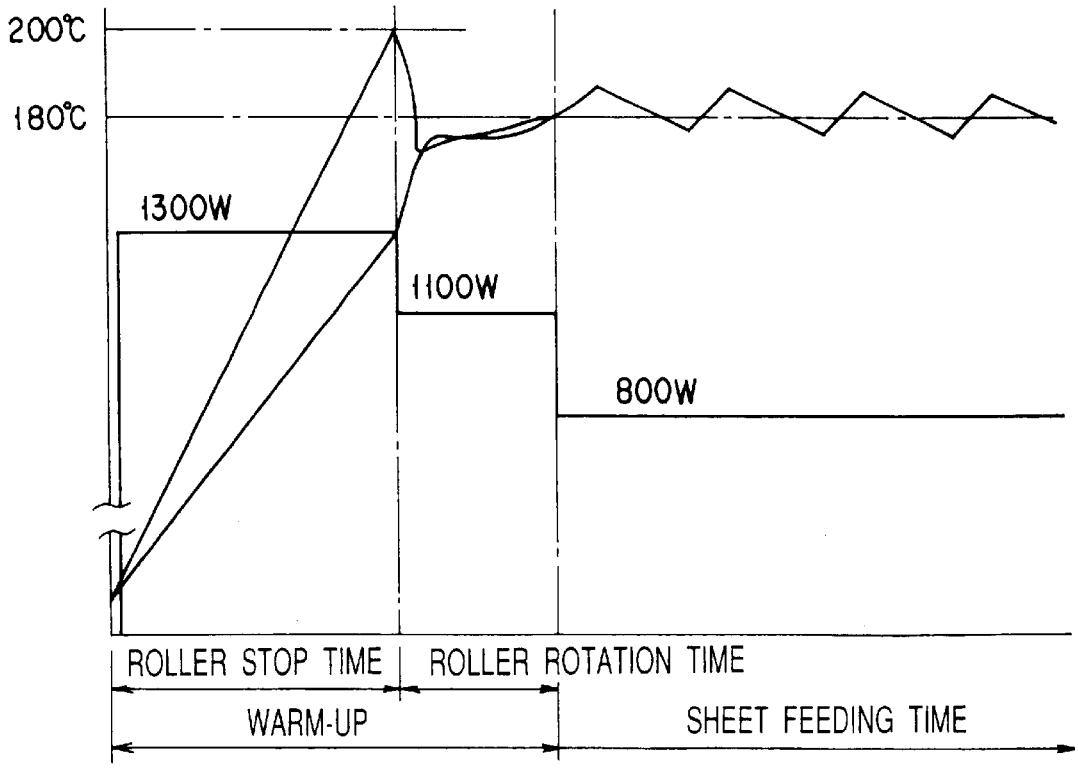
FIG. 8 is a timing chart which explains a relationship between the output and the size of a drive current which can be supplied to the magnetic excitation coil of the fixing device shown in FIG. 2.

FIG. 8 is a timing chart explaining the relationship between the size of a drive current which can be supplied to the magnetic excitation coil 11 and the output.

As shown in FIG. 8, for example, in the initial period of starting up the fixing device, neither the heat roller 2 or the press roller 3 are rotated (stopped). Therefore, no power is consumed by a motor or the like, and accordingly, more power can be used to heat the magnetic excitation coil 11 than that consumed during the operation of feeding a paper sheet. Also, at the time point when the warm-up proceeds and both of the rollers 2 and 3 are rotated, no power is consumed by the motor and the like in the system for conveying paper sheets, and accordingly, more power can be supplied to the magnetic excitation coil 11 than that supplied in the operation of feeding a paper sheet.

More specifically, for example, in a case where the commercial power source is assumed to be 1500 W as shown in FIG. 8, it is possible to supply the magnetic excitation coil 11 with all the electric power defined by subtracting the power amount consumed by devices in the main body of a copying machine, not shown, other than the fixing device. In the case of the embodiment of the present invention, 1300 W is supplied. Thereafter, the heat roller 2 and the press roller 3 are rotated from the middle of the start-up period (from the time point when the temperature of the heat roller 2 exceeds 180° C.). Therefore, 1100 W is supplied as a value defined by subtracting the electric power consumed by the rotation of the motor and the power consumed by other processes.

Thus, in an induction heating fixing device in which the output can be changed by changing the frequency, the heat roller 2 can be heated efficiently by changing the supplied power amount in accordance with a plurality of control patterns.

In order to change the supplied power amount, the output value supplied to the magnetic excitation coil 11 is controlled by changing the time for which the switching element 38 is turned ON, from the IH control circuit 38, based on an IH control signal supplied as a 3-bit signal to the IH control circuit 38 from the main control CPU 39. At this time, as the output is greater, the time for which the switching element 38 is turned ON is extended. Accordingly, the frequency of the output current is lowered.

Meanwhile, when feeding a paper sheet, it is necessary to reduce the output to the magnetic excitation coil 11 as much as possible, on the contrary to the warm-up time. That is, only a minimum output which is necessary to maintain the fixing performance is needed. In the present embodiment, 800 W is set when feeding a paper sheet.

Thus, the high-frequency output of the fixing device can be reduced when feeding a paper sheet (when forming an image), so that the power consumption when feeding a paper sheet can be reduced.

As has been explained above, according to the present invention, it is possible to attain a fixing device which can shorten the warm-up time period so that an excellent fixing performance can be obtained within a short time period. In addition, the total power consumption can be reduced. That is, the temperature is detected by a temperature sensor provided at the position where the temperature of a heat roller is highest in its circumferential direction. In this manner, a rotation operation is started after the temperature reaches a higher temperature than a setting temperature of the surface of the heat roller. After starting the rotation, a high-frequency current is supplied for a magnetic excitation coil for a constant time period, with a higher temperature than an aimed temperature set as an aimed value. Therefore, warm-up can be achieved in a short time period. As has been explained above, it is possible to obtain a fixing device which achieves a short warm-up time, excellent fixing performance, and lower power consumption.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device for use in an electrophotographic apparatus arranged in a structure in which a high-frequency current is flowed through an induction coil provided close to an endless member having a metal layer made of a conductive material and the endless member is caused to generate heat to heat and a fix a material to be fixed, while maintaining a first temperature, wherein when electric conduction to the coil is started and a start-up operation is started, the endless member is rotated when the metal layer reaches a second temperature higher than the first temperature, and for two seconds at most from the start of rotation of the endless member, a high-frequency current having a size corresponding to a control value for a third target temperature is supplied to the coil, the third temperature being lower than the second temperature and higher than the first temperature, and a largest possible input power is momentarily supplied to the fixing device at an optional timing within a period of said two seconds at most so that a temperature of the endless member, which lowers from the start of rotation of the endless member, rises toward the third temperature.

2. The fixing device according to claim 1, wherein the size of the high-frequency current is changed by changing an instruction value to an output circuit which supplies the coil with a current.

3. The fixing device according to claim 1, wherein temperature detection means for detecting a temperature of the metal layer of the endless member are provided at least two positions at a predetermined interval in a rotating direction of the metal layer of the endless member.

4. The fixing device according to claim 1, further comprising:

at least two temperature detection means for detecting a temperature of the metal layer of the endless member and that are spaced from each other at a predetermined distance in a longitudinal direction of the endless member.

5. The fixing device according to claim 4, wherein at least one of said at least two temperature detection means is located substantially at a center of the endless member in the longitudinal direction thereof.

6. The fixing device according to claim 4, wherein at least one of said least two temperature detection means is located close to an end portion of the endless member in the longitudinal direction thereof.

7. The fixing device according to claim 4, wherein the coil is an air coil.

8. The fixing device according to claim 7, wherein at least one of said least two temperature detection means is located close to an end portion of the endless member in the longitudinal direction thereof.

9. The fixing device according to claim 8, wherein at least one of said at least two temperature detection means is located substantially at a center of the endless member in the longitudinal direction thereof.

10. A fixing device for use in an electrophotographic apparatus arranged in a structure in which an alternating current is passed through an induction coil provided close to an endless member having a metal layer made of a conductive material, and the endless member is caused to generate heat to heat a material to be fixed, wherein in a warm-up period, an electric power amount supplied to the induction coil is changed in a plurality of steps, in compliance with the operation of another component, and in one of the steps, for two seconds at most from the start of rotation of the endless member, a high-frequency current having a size corresponding to a control value for a first temperature is supplied to the coil, and a largest possible input power is momentarily supplied to the fixing device at an optional timing within a period of said two seconds at most so that a temperature of the endless member, which lowers from the start of rotation of the endless member, rises toward a second temperature lower than the first temperature.

* * * * *